United States Patent [19]

Yellin

[11] 3,945,696

[45] Mar. 23, 1976

[54] MEANS FOR CONVERTING AN OPEN-SHELVED UNIT OR ETAGERE TO A CLOSED CABINET WITH SLIDABLE DRAWERS

[76] Inventor: Bernard Yellin, 5252 S. Kolmar Ave., Chicago, Ill. 60632

[22] Filed: Jan. 24, 1975

[21] Appl. No.: 543,669

[52] U.S. Cl. ..... 312/257 R; 312/111

[51] Int. Cl.[2] ..... A47B 47/00; A47B 57/08

[58] Field of Search ..... 312/257 R, 257 SK, 214, 312/333, 108, 111

[56] References Cited

UNITED STATES PATENTS

| | | | |
|---|---|---|---|
| 3,497,279 | 2/1970 | Chovanec | 312/257 R |
| 3,738,726 | 6/1973 | Burst | 312/257 R |
| 3,848,942 | 11/1974 | Favini | 312/214 |
| 3,877,765 | 4/1975 | Hassing | 312/111 |

*Primary Examiner*—Casmir A. Nunberg
*Attorney, Agent, or Firm*—Max R. Kraus

[57] ABSTRACT

Means for converting an open-shelved unit or etagere to a closed cabinet with slidable drawers, the open-shelved unit comprising top and bottom horizontal members and spaced upright members which are detachably secured to the corners of said spaced top and bottom members to form an open-shelved unit or etagere, the top and bottom of said units being molded of a plastic material in the same or identical mold cavity, with all of the upright members also identical and being molded in the same or identical cavity, the invention herein comprising the means for converting said open-shelved unit or etagere to a closed cabinet with slidable drawers, the said means for each unit comprising a molded frame-like member having end channels or grooves and positioned against the underside of the top member, a pair of end panels on each of the opposite ends of the unit comprising an outer panel and an inner panel held in spaced relation to each other between said top and bottom horizontal members with the inner panel having spaced horizontal flanges and with a plurality of drawers positioned on said oppositely spaced flanges so that the drawers may be manually slid into and out of said cabinet and with said drawers when in closed position forming a closed cabinet with drawers. The open-shelved units and the means for converting same to a closed cabinet are packed and shipped in disassembled knockdown condition and readily assembled at the point of use without the use of any tools or extraneous fastening means. Each of the drawers is similarly constructed and readily positionable into sliding engagement with said formed structure.

7 Claims, 5 Drawing Figures

MEANS FOR CONVERTING AN OPEN-SHELVED UNIT OR ETAGERE TO A CLOSED CABINET WITH SLIDABLE DRAWERS

BRIEF SUMMARY OF THE INVENTION

Open-shelved units used either individually to form a two-shelf etagere or with a plurality of such units stacked and interlocked with each other in the form of a tier or the like are old and well-known in the art. Such units have top and bottom horizontal members which are interconnected to form shelves and are open at the sides and ends. These units are particularly of a decorative character and are used principally in a home but not limited thereto.

An object of this invention is to provide such a unit which has preformed channels or grooves at each of its opposite ends and a pair of spaced end panels at each of the opposite ends, with the inner panels having spaced horizontal flanges or ledges to slidingly receive one or more slidable drawers so that the open-shelved unit is readily convertible to a closed cabinet with one or more slidable drawers for storage purposes. The said unit is detachably secured to other similar units to form a tier of such units.

Another object of this invention is to form the etagere of plastic material in which the members, including the drawers which convert the etagere to a closed cabinet with slidable drawers, are likewise molded of a plastic material.

Another object of this invention is to provide a structure of the foregoing character in which the open-shelved unit or etagere and the means for converting same to a closed cabinet with slidable drawers are packed and shipped in a knockdown condition and may be readily assembled by the user without the use of any tools and/or extraneous fastening elements, and same being readily set up for use as either an individual unit or as a tier of units or combination of tiers to form any desired arrangement.

Another object of this invention is to provide a structure of the foregoing character which may be economically manufactured of plastic material and requires a minimum number of mold cavities and which is readily assembled and disassembled by the user.

BRIEF DESCRIPTION OF THE DRAWINGS

In the drawings:

FIG. 1 shows one of the units disassembled and in an exploded view. Said unit comprises a bottom member 12 and a top member 12′, both of which are of identical construction and molded in the same mold cavity and made of plastic. Since both of said members are identical only one will be described in detail.

Figures 1, 2, 5:
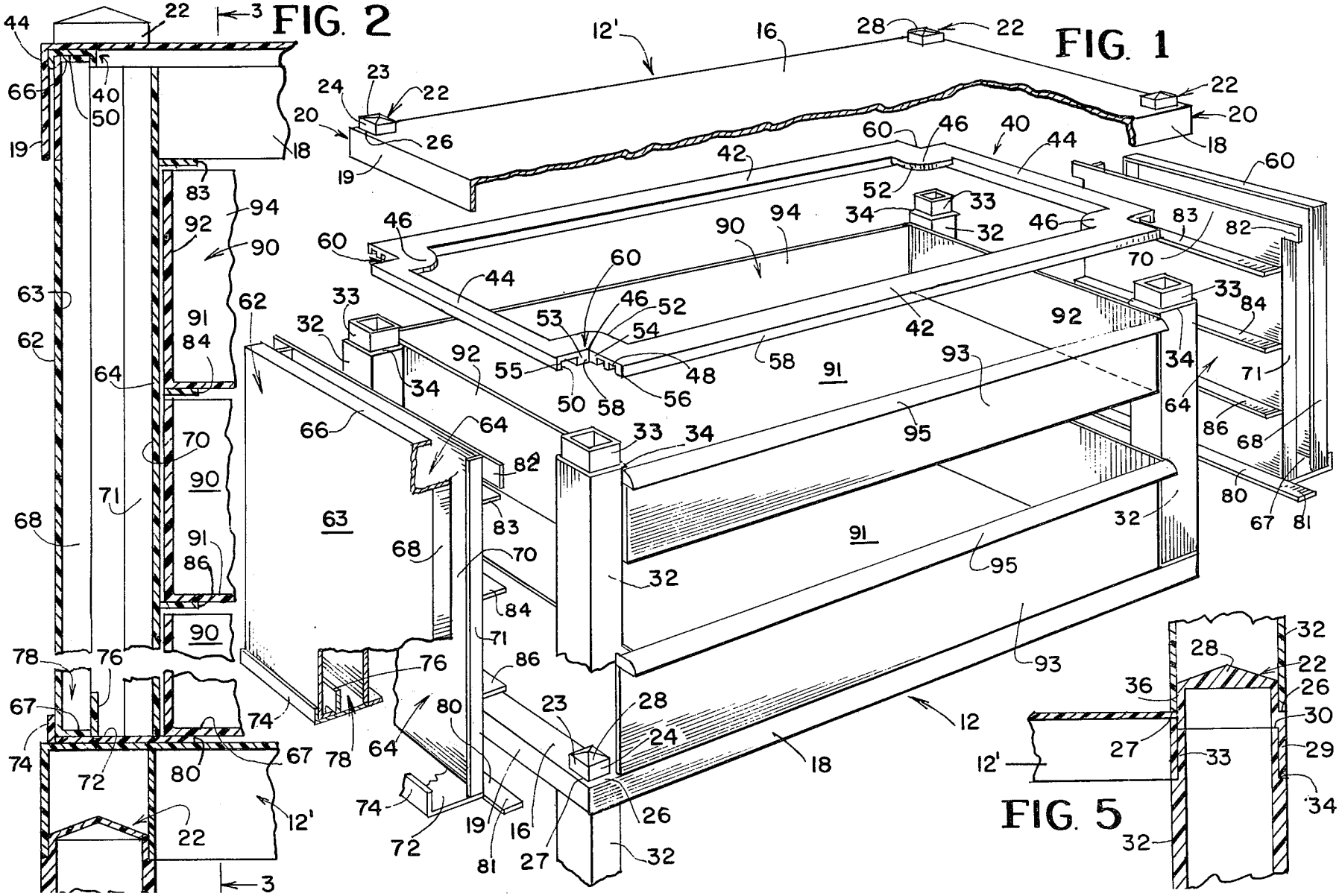
FIG. 1 is an exploded view showing a single unit and the parts disassembled for converting an open-shelved unit or etagere to a closed cabinet with slidable drawers, same showing two drawers, the third drawer being omitted for purpose of clarity.
FIG. 2 is a sectional view showing the components of FIG. 1 in assembled relation where it forms a cabinet with slidable drawers.
FIG. 5 is an enlarged sectional view taken on line 5—5 of FIG. 1.

The member 12 or 12′ is of rectangular shape and comprises a horizontal wall 16 with downwardly depending spaced sides 18 and downwardly depending ends 19 connected to said sides 18 to form a continuous flanged surface. Formed adjacent each of the four corners 20 and extending upwardly of the horizontal wall 16 is a square-shaped extension 22, the two outermost adjacent sides 23 and 24 of which are positioned slightly inwardly of the side and end walls 18 and 19 so that the wall 16 forms right-angled shoulders 26 and 27 at said extensions. The top of the extension 22 is closed by a top wall 28 having a pyramidal shape for ornamental purpose. Extending downwardly at each of the corners is a square-shaped socket 29, best shown in FIG. 5, with the innermost portion of the socket being of a reduced dimension to provide a continuous shoulder 30 in the interior of said socket.

The two identical members 12 and 12′ forming the top and bottom are used for forming a single unit, whereas a number of such members are used when forming a tier of such units of any height. To complete the framework of a single unit there are four tubular upright members each generally indicated at 32 formed of plastic material and all are formed in the same or similar mold cavity. Said upright tubular members 32 are square-shaped in cross-section, with the opposite ends open. The upper portion of each upright 32 has an end section 33 of reduced dimension which is also square-shaped in cross-section and provides a shoulder 34. The bottom of each tubular upright member 32 is open as at 36 so that it can interconnect with the top of the lower reduced extension 33 of the lower tubular member 32, as best shown in FIG. 5.

To connect the top and bottom members 12 and 12′, best shown in FIGS. 2 and 5, the open-ended bottom 36 of the tubular upright member 32 is slipped on the extension 22 of the bottom member 12, with the end of said tubular upright member 32 abutting against the shoulders 26 and 27. The reduced extension 33 at the top of the upright is inserted into the square-shaped socket 29 of the top member 12′ until the end of the reduced extension 33 abuts against the inside shoulder 30 of the socket 29, with the top and bottom members 12 and 12′ and with the four upright members 32 thus secured to said top and bottom members a single open-shelved unit is formed, the parts being held together by frictional contact and without the use of any extraneous fastening means. Each of these units, sometimes herein referred to as a "framework" is in fact an open-shelved unit or etagere due to the fact that the opposite sides and opposite ends are open and the top and bottom horizontal members 12 and 12′ may each be used as a shelf upon which objects are supported.

To convert the open-shelved unit or units described into closed cabinets with slidable drawers there is provided for each of said units a generally rectangular-shaped frame-like member generally indicated at 40 which is molded of plastic material, best shown in FIG. 1. Said frame-like member 40 consists of a pair of spaced side strips 42 connected to spaced end strips 44 by a connecting piece 46. The side strips 42 are each formed with two channels 48 and the end strips 44 are each formed with a single channel or groove 50. The connecting piece 46 has a generally arcuate shape in plan view with a curved inner edge 52. The outer edges 53 and 54 of the connecting piece 46 are at substantially right angles to each other and are planar, with the end edges 55 and 56 of the side and end strips 42 and 44. The outer edges 53 and 54 have a downwardly extending flange 58 which is of the same height as the vertical walls forming the channels 48 and 50. As will best be seen in FIG. 1, each of the four corners of the frame-like member is cut out or recessed inwardly as at 60 to form a right-angled recessed corner at each corner so that when the frame-like member 40 is positioned against the underside of the top horizontal member 12′ the cutout or recessed corners 60 are positioned adjacent the reduced ends 33 of the respective uprights 32. This properly positions the upper frame-like member 40 with the grooves or channels 48 and 50 facing downwardly. Each of the opposite end channels or grooves 50 of the frame member 40 is adapted to support at each end the upper end of one of the end panels, namely, the outer end panel, as will be hereinafter described.

The opposite ends of each of the units are each closed by a pair of stationary closure outer and inner end panels generally indicated at 62 and 64 respectively, both of rectangular shape. The outer end panel 62 has a vertical wall 63 bounded by a continuous inwardly extending border flange, the top and bottom flanges being designated at 66 and 67 respectively and the vertical side flanges at 68. The outer end panels 62 are both of the same construction and may be molded in the same or identical mold cavity. The upper flange 66 of the outer end panel 62 fits within the groove or channel 50 of the rectangular-shaped frame member 40 when the parts are assembled. The bottom flange 67 of said outer end panel 62 will fit within a guideway or channel formed as part of the inner end panel 64, now to be described.

Figure 4:
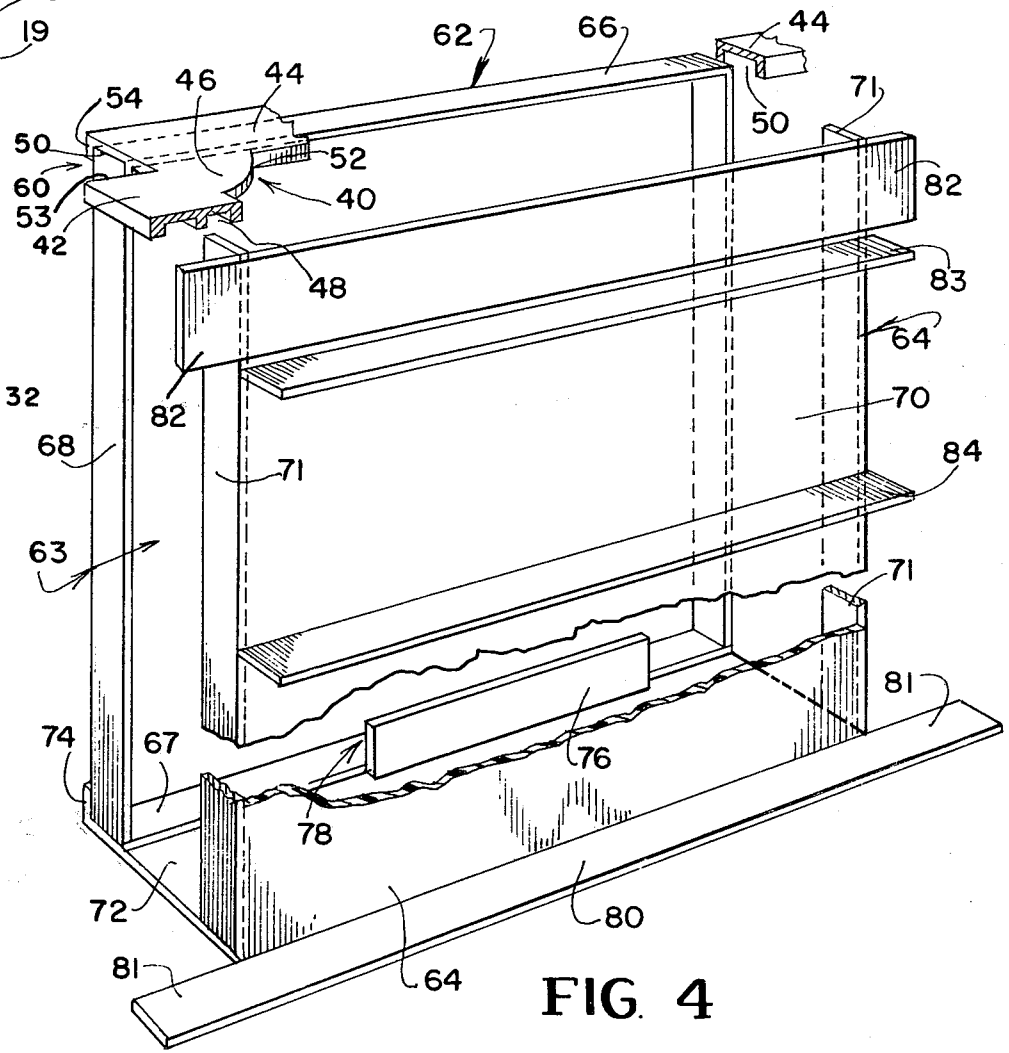
FIG. 4 is an exploded perspective showing a portion of the top channeled member and the spaced end panels which form each of the opposite ends of the unit, with the inner panel forming the support for the slidable drawers.

The inner end panel 64 has the means for supporting the slidable drawers. The inner end panel 64 comprises a vertical end wall 70 having outwardly extending vertical side flanges 71 at each of the opposite sides, which flanges are relatively narrow and extending outwardly of the bottom of the end wall 70 is an outward extension or bottom flange 72 of generally rectangular shape which is coextensive with the width of the end panel. Said outward extension or flange 72 has an upwardly extending flange or lip 74 at the outer end thereof. Positioned on said outward extension or flange 72 is an upwardly and vertically extending rib 76 positioned intermediate the flange 74 and the end wall 70 to provide a channel 78 for receiving the bottom flange 67 of the outer panel 62. The opposite ends of the lip 74 terminate inwardly from the ends of the extension or flange 72, as best shown in FIG. 4. Adjacent the bottom of the inner panel 64 is an inwardly facing horizontal extension or bottom flange 80, the opposite ends 81 of which extend beyond or exteriorly of the width of the panel 64, as best shown in FIG. 4. The upper end of the vertical wall 70 of said panel 64 likewise extends laterally or exteriorly as at 82 of the vertical side flanges 71 of said panel. Facing inwardly of the wall 70 of said panel are three spaced flanges 83, 84 and 86, best seen in FIG. 1, with said flanges being coextensive with the width of the wall of the panel 64. The top flange 83 is positioned below the top edge of the wall 70 and the intermediate flanges 84 and 86 are equally spaced from the top flange 83 and the bottom flange 80 so that three slidable drawers are supported by said flanges. A greater or lesser number of such flanges may be used with proper spacing therebetween to hold a larger or smaller number of slidable drawers.

In final assembled position, the outer and inner end panels 62 and 64 are positioned as best seen in FIG. 2, with the inner panel 64 positioned adjacent the inwardly facing surfaces of the spaced uprights 32 and with the top and bottom extensions 82 and 81 positioned against the uprights 32 and the inner panel will be properly positioned. To hold the inner panel in its proper position it has to be interlocked with the outer panel 62 in the following manner.

The bottom of the inwardly extending flange 67 of the outer end panel 62 is positioned in the channel 78 between the upwardly extending flange 74 and the inwardly extending rib 76. The top inwardly extending flange 66 of the outer end panel 62 fits within the end channel or groove 50 of the framework member 40 which is positioned against the underside of the top horizontal member 12′ of each unit prior to the positioning of the end panel. The outer end panel 62 is thus in a secured position and is held at the bottom by the bottom extension or flange 72 of the inner panel 64 and at the top by the end groove 50 of the frame member 40. When the inner and outer panels are thus positioned the outer panel extends upwardly of the top of the inner panel. The inner and outer panels are thus spaced from each other. The extensions 81 on the bottom flange 80 of the inner panel will be in engagement with the tubular uprights 32, and the extensions 82 on the top of the inner panel will likewise be in engagement with the upper portions of the tubular uprights 32. The inwardly extending horizontal flanges 83, 84, 86, and bottom flange 80 of the inner panel will support three slidable drawers, each generally indicated at 90.

The drawers 90 are identically constructed and are all molded preferably of a plastic material. Since all are of identical construction only one will be described. The drawer is of rectangular shape and comprises a bottom wall 91, spaced side walls 92 and spaced front and rear walls 93 and 94, with the front wall 93 having an overhanging lip 95 which is curved downwardly so that it may be manually engaged for manually sliding the drawer into and out of each unit. When the framework member and the end panels are assembled and the drawers are inserted, the unit is converted from an etagere to a closed cabinet with slidable drawers. All of this may be done by merely positioning the parts relative to each other and attaching them by interfitting the parts. No extraneous fastening elements are needed to secure the parts together.

Figure 3:
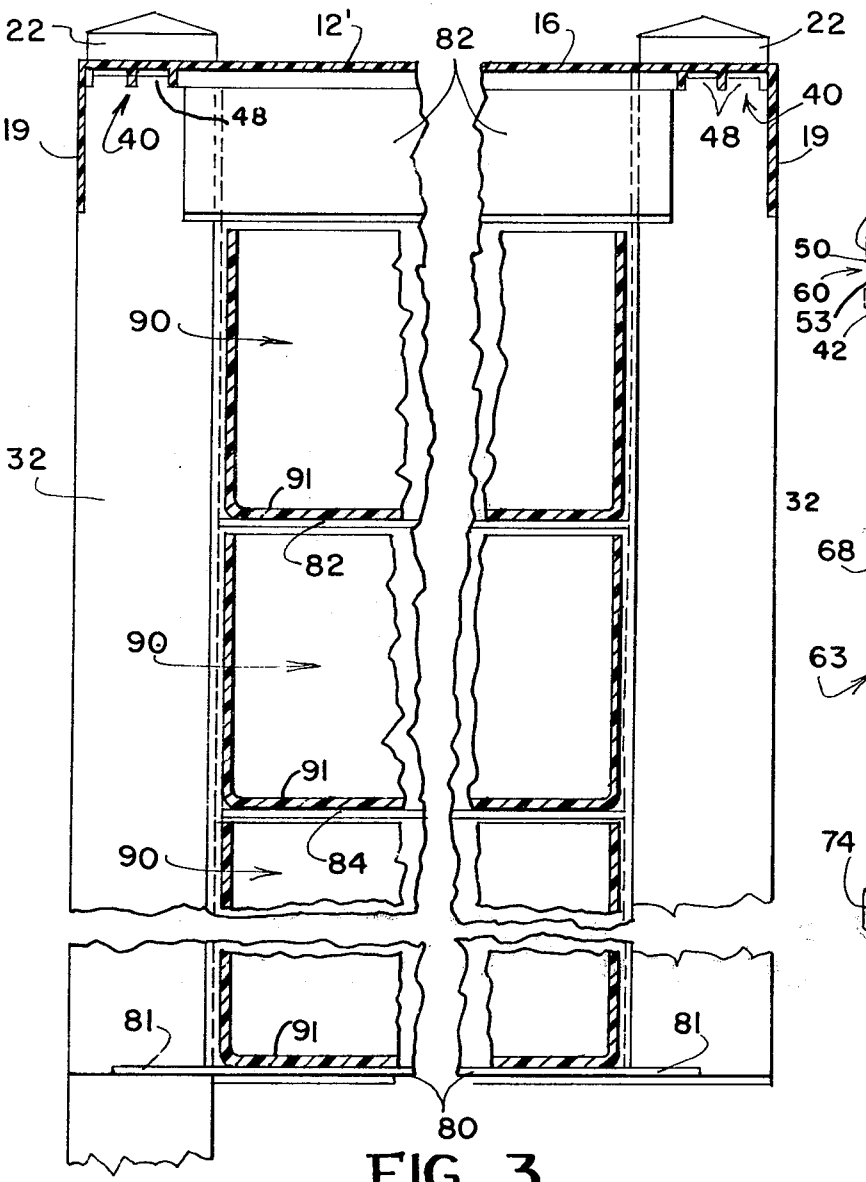
FIG. 3 is a sectional view taken on line 3—3 of FIG. 2.

While the foregoing is described in connection with a single framework or single open-shelved unit, it will be understood that a plurality of such units, each convertible into a cabinet unit with slidable drawers in accordance with this invention, may be interlocked to form a tier of such cabinets and slidable drawers as each unit can be interlocked with similarly constructed other units. FIGS. 1, 2 and 3 show the positioning and manner of interlocking one unit with another like unit positioned therebelow or thereabove, with the reduced ends 33 of the tubular uprights 32 of the lower unit interlocked in the sockets 29 of the upper unit, and the bottom of the upper tubular uprights 32 positioned on the extensions 22 of the horizontal members 12′. Thus, each separate unit may be positioned one on top of the other and interlocked to form a tier. The parts are all detachably connected so that the unit can be readily disassembled when desired. The units may be shipped in a knockdown condition and readily assembled for use.

What is claimed is:

1. Means for converting an open-shelved unit to a closed cabinet with a slidable drawer, said open-shelved unit comprising, a top horizontal member and a bottom horizontal member, each said horizontal member having means adjacent the corners thereof for detachably receiving an upright whereby said uprights when attached to said top and bottom horizontal members space said top and bottom horizontal members and connect same; the means for converting said open-shelved unit to a closed cabinet with slidable drawer comprising a pair of end panels positioned at each end between said bottom and top horizontal members and said uprights, each said pair of end panels comprising an outer and an inner end panel with said inner panels having means engaging a pair of spaced uprights to position said inner end panels relative to said uprights, each said inner end panel having an outwardly extending bottom flange providing a channel for receiving and holding the bottom of the outer panel to hold said outer panel relative to said inner panel and secure same to said open-shelved unit, a groove or channel adjacent the underside of said top horizontal member for receiving and holding the top of the outer panel, a slidable drawer, each said inner end panel having means for receiving said slidable drawer to permit the drawer to be manually slid into and out of said unit.

2. Means for converting an open-shelved unit to a closed cabinet with a slidable drawer, said open-shelved unit comprising, a top horizontal member and a bottom horizontal member, each said horizontal member having means adjacent the corners thereof for detachably receiving an upright whereby said uprights when attached to said top and bottom horizontal members space said top and bottom horizontal members and connect same; the means for converting said open-shelved unit to a closed cabinet with a slidable drawer comprising a pair of adjacent end panels positioned at each end between said bottom and top horizontal members and said uprights, each said pair of adjacent end panels comprising an outer and an inner end panel with said inner panels having means engaging a pair of spaced uprights to position said inner end panels relative to said uprights, one or the other of the inner or outer end panels having means engaged by the other adjacent end panel to hold said outer panel relative to the inner panel and secure same to said open-shelved unit, a groove or channel adjacent the underside of said top horizontal member for receiving and holding the top of the outer panel, a slidable drawer, each said inner end panel having means for receiving said slidable drawer to permit the drawer to be manually slid into and out of said unit.

3. A structure as set forth in claim 2 in which each of the inner end panels has spaced means for supporting a plurality of slidable drawers, each slidable independently of the other.

4. A structure as set forth in claim 2 in which the groove or channel adjacent the underside of the top horizontal member is in a frame-like member in which the opposite ends thereof have said channel or groove to receive and retain the upper end of the outer panel.

5. A structure as set forth in claim 4 in which the frame-like member has recesses or cutouts at the corners thereof to engage the uprights adjacent the underside of the top horizontal member.

6. A structure as set forth in claim 1 in which a plurality of units are positioned to form a tier of such units and in which each unit has the top horizontal member and the bottom horizontal member with sockets on the underside thereof and with extensions extending upwardly thereof, which sockets receive the top of the uprights and which extensions receive the bottom of said uprights, and in which a tier of such units are formed by connecting other uprights to said extensions and sockets of other horizontal members.

7. Means for converting an open-shelved unit to a closed cabinet with a slidable drawer, said open-shelved unit comprising, a top horizontal member and a bottom horizontal member, each said horizontal member having means adjacent the corners thereof for detachably receiving an upright whereby said uprights when attached to said top and bottom horizontal members space said top and bottom horizontal members and connect same; the means for converting said open-shelved unit to a closed cabinet with slidable drawer comprising a pair of end panels positioned at each end between said bottom and top horizontal members and said uprights, each said pair of end panels comprising an outer and an inner end panel with said inner panels having means engaging a pair of spaced uprights to position said inner end panel relative to said uprights, each said inner end panel having means engaged by said outer panel to hold said outer panel relative to said inner panel and secure same to said open shelved unit, means adjacent the underside of the top horizontal member to receive and retain the upper end of said outer panel, said last mentioned means comprises a frame-like member having opposite ends each of which has a channel or groove to receive and retain the upper end of the outer panel, said frame-like member having recesses or cutouts at the corners thereof to engage the uprights adjacent the underside of the top horizontal member.

* * * * *